US006168533B1

(12) United States Patent
Camara

(10) Patent No.: US 6,168,533 B1
(45) Date of Patent: Jan. 2, 2001

(54) GOLF GAME

(75) Inventor: Octavio Camara, London (CA)

(73) Assignee: Camara Games Inc., London (CA)

( * ) Notice: Under 35 U.S.C. 154(b), the term of this patent shall be extended for 0 days.

(21) Appl. No.: 09/058,867

(22) Filed: Apr. 13, 1998

(51) Int. Cl.[7] ..... A63D 15/00
(52) U.S. Cl. ..... 473/3; 473/10; 473/4
(58) Field of Search ..... 473/3, 7, 8, 4, 473/31, 10, 159, 15, 157; 273/DIG. 7, 118 R, 123 R, DIG. 13, DIG. 30; 150/160

(56) References Cited

U.S. PATENT DOCUMENTS

| | | | | |
|---|---|---|---|---|
| 83,759 | * | 11/1868 | Buzby | 473/3 |
| 252,805 | * | 1/1882 | Saunders | 473/6 |
| 278,341 | | 5/1883 | Kelly . | |
| 723,378 | * | 3/1903 | Fuller | 473/3 |
| 1,049,948 | * | 1/1913 | Water | 473/8 |
| 1,845,531 | | 2/1932 | Terry . | |
| 1,979,177 | | 10/1934 | Staff | 273/3 |
| 2,510,985 | | 6/1950 | Kummer | 273/3 |
| 3,138,387 | * | 6/1964 | Michel | 473/173 |
| 3,578,321 | | 5/1971 | Skully | 273/2 |
| 3,591,176 | | 7/1971 | Roth | 273/6 |
| 3,715,123 | | 2/1973 | Baum | 273/35 R |
| 3,825,258 | * | 7/1974 | Frierman | 473/3 |
| 4,195,677 | * | 4/1980 | Hagg et al. | 150/160 |
| 4,229,004 | * | 10/1980 | Stokes | 473/3 |
| 4,579,342 | * | 4/1986 | Mortensen | 473/3 |
| 4,877,250 | * | 10/1989 | Centafanti | 473/157 |
| 4,957,288 | * | 9/1990 | Kantner | 473/3 |
| 5,083,778 | * | 1/1992 | Douglass | 473/329 |
| 5,116,048 | | 5/1992 | Bilocerkowycz et al. | 273/87 B |
| 5,464,212 | * | 11/1995 | Cook | 473/329 |
| 5,591,087 | * | 1/1997 | Salinas | 473/3 |

FOREIGN PATENT DOCUMENTS 2202454 9/1988 (GB) .

* cited by examiner

*Primary Examiner*—Sebastiano Passaniti
*Assistant Examiner*—Mitra Aryanpour
(74) *Attorney, Agent, or Firm*—Evenson, McKeown, Edwards & Lenahan, P.L.L.C.

(57) ABSTRACT

A portable pool/golf game includes a plurality of rails each having first and second rail ends and a plurality of ball pockets, each ball pocket being arranged between adjacent ones of the plurality of said rails. A plurality of male/female connectors couple the plurality of rails and the plurality of ball pockets together. The connected plurality of rails and plurality of ball pockets define a boundary. A playing surface member has a top surface, a bottom surface and lateral edges. The boundary formed by the plurality of rails and the plurality of ball pockets is arranged at the lateral edges on the top surface of the playing surface member. A fastener is arranged on a bottom surface of the plurality of the rails to secure the boundary to the top surface of the playing surface member.

10 Claims, 8 Drawing Sheets

GOLF GAME

BACKGROUND OF THE INVENTION

The present invention relates to a portable pool/golf game that combines elements of both golf and pool and, more particularly, to a portable pool/golf game using a golf-style ball striking instrument together with a pool table style surface configuration.

Portable pool/golf games are known. For example, a known game, Executive Putterpool™, makes use of sixteen golf balls that are printed like pool balls. The game uses six high-impact plastic putting cups, numbered one through six, which can be randomly arranged on a floor surface or configured as pockets of a billiard table. A major disadvantage of this known pool/golf game is that no boundaries are provided to truly simulate a pool table surface. Further, the plastic putting cups have excessively wide openings and very little height such that they likewise do not realistically simulate a billiard pocket.

Other U.S. patents, for example, U.S. Pat. Nos. 278,341, 1,845,531, 3,138,387 disclose various games resembling miniature golf or pool. These games are all designed with unique features such that they do not realistically simulate either a pool or a golf game. Other combined pool/golf games are disclosed in U.S. Pat. Nos. 3,578,321, 4,957,288, 4,579,342 and 5,591,087. These pool/golf game devices have various disadvantages. For example, U.S. Pat. Nos. 3,578,321 and 4,579,342 require a solid base such as concrete (U.S. Pat. No. 4,579,342) or plywood (U.S. Pat. No. 3,578,321). While these bases provide a sturdy support for the game device, they disadvantageously are not portable nor easy to assemble. By contrast, U.S. Pat. Nos. 4,957,288 and 5,591,087 describe the use of a mat such as carpeting or felt to form the surface of the game. However, the use of such mats presents its own problems as the players tend to rumple or disturb the playing surface when in use. This disturbs the play of the game and requires frequent repositioning of the game surface.

SUMMARY OF THE INVENTION

It is an object of the present invention to provide a portable pool/golf game that combines elements of both golf and pool.

It is another object of the present invention to provide a portable pool/golf game with bumpers having bumper characteristics realistically simulating a conventional pool/billiard table.

Another objective of the present invention is to provide a portable pool/golf game that sits at floor level such that players can stand within the game surface to execute shots. Alternatively, the present invention is versatile enough to be assembled and used on a table top such as a table tennis or other similar table top surface in which case billiard cue sticks can be used in lieu of a golf-style putter.

Yet another object of the present invention is to provide a portable pool/golf game having an interlocking rail system which prevents detachment of the game components that otherwise may occur due to high velocity shots.

It is yet another object of the present invention to provide a portable pool/golf game that has pockets which prevent balls from popping back out onto the playing area to more realistically simulate a pool/billiard table, without requiring the pockets to extend below the playing surface.

Another object of the present invention is to provide a pool/golf game that uses a floor covering that can be rolled up and used either indoors or outdoors. The floor covering is secured primarily to the rails of the pool-style surface configuration such that it is not displaced by the user when in use.

Still another objective is to provide a pool/golf game that requires no tools or permanent fasteners to assemble and secure.

Yet another objective is to provide a pool/golf game that can be used with regular golf putters and balls for putting practice.

It is still another objective of the present invention to provide a pool/golf game that is not permanently attached to any surface and can be assembled and disassembled for storage or removal.

These objects are accomplished by providing a portable pool/golf game including a plurality of rails each having first and second rail ends; a plurality of ball pockets, each ball pocket being arranged between adjacent ones of said plurality of said rails; a plurality of male/female connectors coupling the plurality of rails and the plurality of ball pockets together, the connected plurality of rails and plurality of ball pockets defining a boundary; and a playing surface member having a top surface, a bottom surface and lateral edges; wherein the boundary formed by the plurality of rails and the plurality of ball pockets is arranged at the lateral edges on the top surface of the playing surface member; and a fastener is arranged on a bottom surface of the plurality of rails to secure the boundary to the top surface of the playing surface member.

Advantageously, the playing surface of the invention is removably secured to each side rail and end rail to maintain its relative position with respect to the rails when in use. The playing surface is secured to the rails via a hook and loop-type of fastener such as the commercially available Velcro® fastener.

The present invention provides a sports and leisure game combining elements of golf and pool and having the appearance of a pool/billiard table top. The present invention is designed to be played on the floor. Alternatively, the game can also be assembled on a table top such as a table tennis or similar table top surface provided the table top is of a sufficient size, for example, 4 ft.×8 ft., and is reasonably sturdy. It can be played indoors or outdoors. The invention is totally portable and can be stored away for convenience. Furthermore, it has four corner pockets, two side pockets, pocket ramps, rails with bumpers, all attached to a playing carpet surface. Various games are played with the present invention using a set of sixteen miniature pool balls, two safety golf putters for making shots and a golf ball for putting practice. When used as a table top game, conventional pool cue sticks can be used instead of the golf putters.

Other objects, advantages and novel features of the present invention will become apparent from the following detailed description of the invention when considered in conjunction with the accompanying drawings.

DETAILED DESCRIPTION OF THE DRAWINGS

Figure 1A:
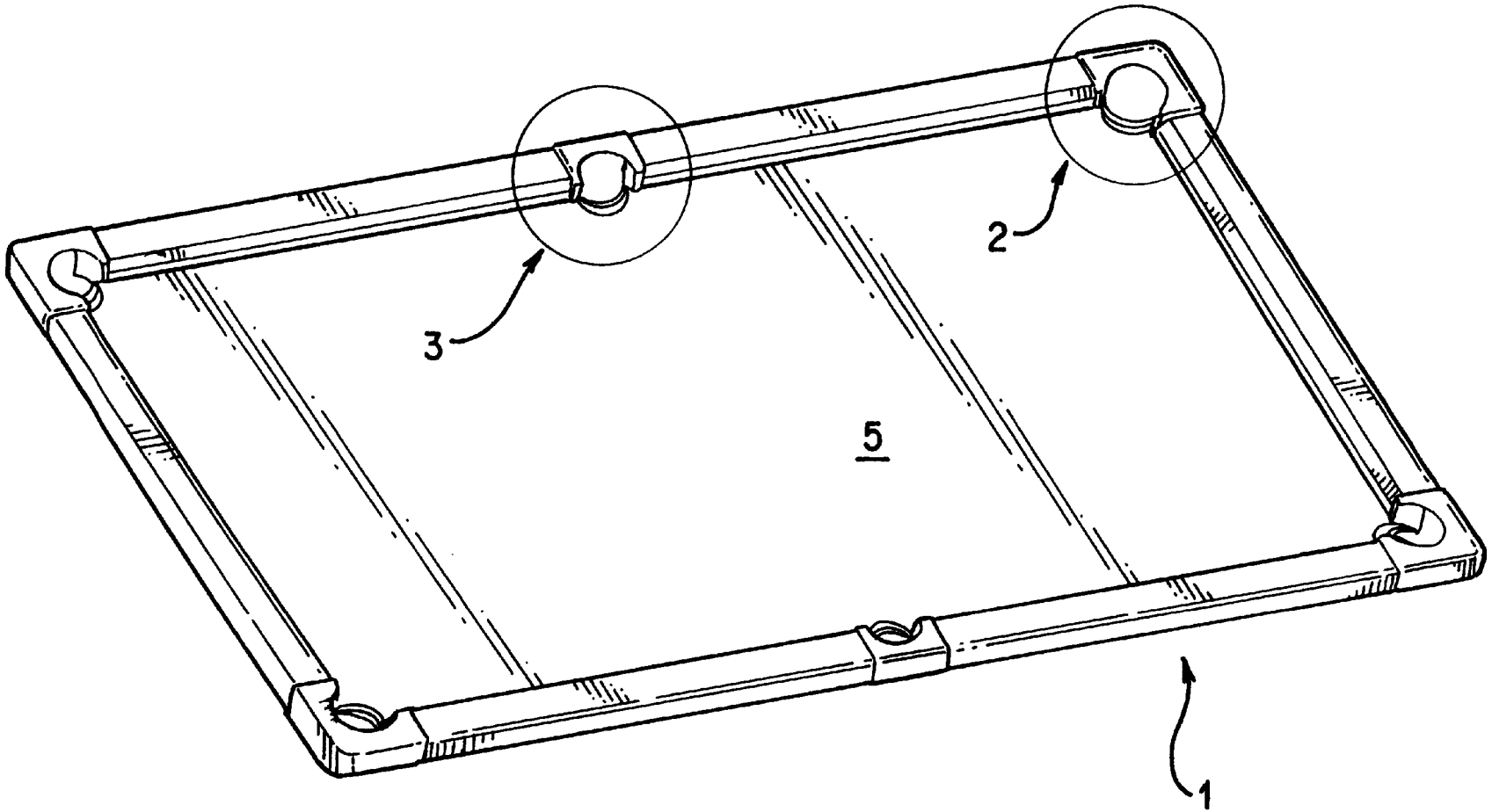
FIG. 1A is an overall perspective view of the portable pool/golf game according to the invention.
Figure 1B:
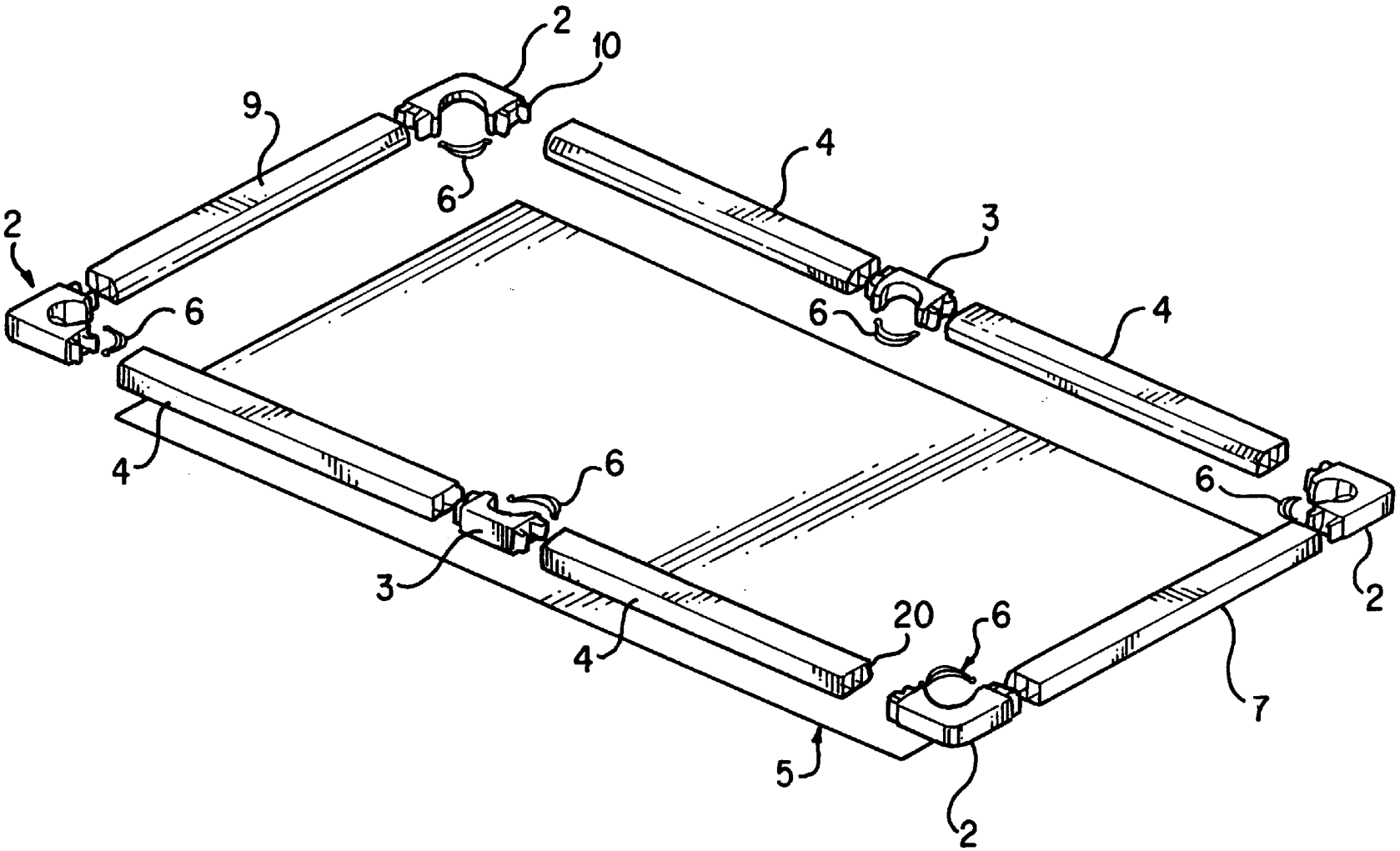
FIG. 1B is an overall perspective view of a disassembled portable pool/golf game according to the invention.

FIG. 1B is an overall perspective view of a disassembled portable pool/golf game according to the present invention. A number of side rails 4 are provided, one end of each side rail 4 being inserted into one end of a designated corner pocket 2 in order to secure the rail to the pocket. For example, the rails may have at their free end, a female socket 20 which mates with a corresponding male connector 10 arranged on the pocket. The opposite end of each side rail 4 is inserted into a connector formed on an end of a side pocket 3. End rails 7 are provided which are secured at opposite ends to corner pockets 2 so as to form an end rail surface of the pool/golf game.

In order to assemble the portable pool/golf game, two corner pockets 2 are connected at the opposite ends of one end rail 7. A playing surface 5, such as a playing carpet or mat, is laid flat over an underlying floor surface. The end rail 7 is provided on its bottom surface with a fastening device, such as a hook and loop-type fastener, for example, Velcro®, in order to securely fasten the rail to the playing surface 5. The end rail 7 and corner pockets 2 are aligned flush with the narrow end of the playing surface 5 and are then placed on the playing surface 5 to engage the fastening device. Advantageously, if a hook and loop type fastener is used together with a carpeted playing surface 5, then only the hook component of the hook and loop fastener is necessary on the bottom of the rail in order to secure it to the already existing carpet loops. Otherwise, the loop component of the hook and loop fastener can be arranged at the edges of the playing surface 5.

Next, the side rails 4 are connected at one end to the corner pockets 2 which are already secured to the playing surface 5. As with the end rail 7, the side rails 4 can also be provided with a fastening device to secure the rails to the playing surface 5. Thereafter, the side pockets 3 are coupled to the fastened side rails 4 and the further set of side rails 4 are fastened to the opposite end of the side pockets 3. Finally, the other end rail system consisting of the end rail 7 and corner pockets 2 are secured to the side rails 4 and the playing surface 5 in order to form the portable pool/golf game surface configuration.

Figure 6:
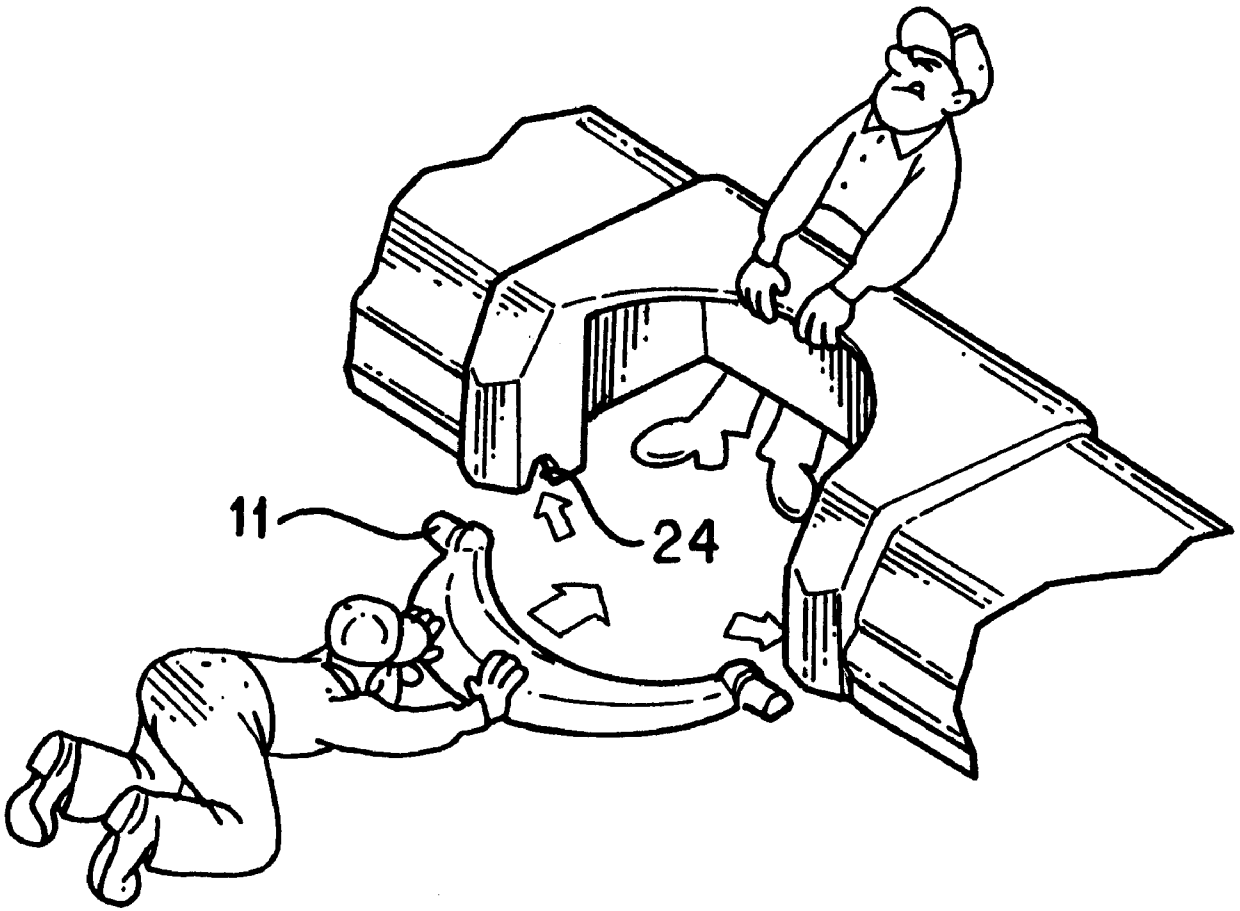
FIG. 6 is a perspective view illustrating the connection between a retaining ramp and a respective side ball pocket according to the present invention.

Once the pool/golf game surface is constructed, ball retaining ramps 6 are coupled to each of the pockets 2 and 3 via connectors 11 which engage in openings 24 of the ball pockets as shown in greater detail in FIG. 6.

Figure 2A:
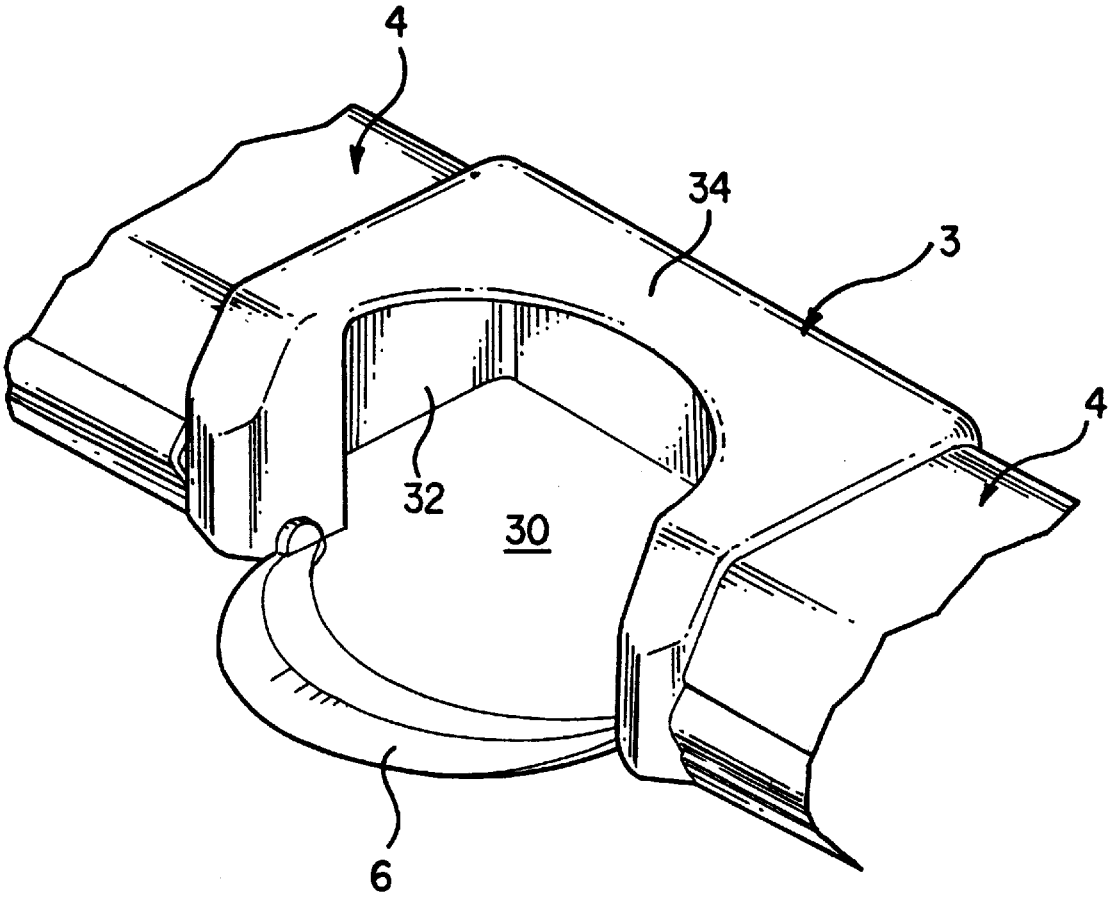
FIG. 2A is a perspective view of a side pocket according to the invention.
Figure 2B:
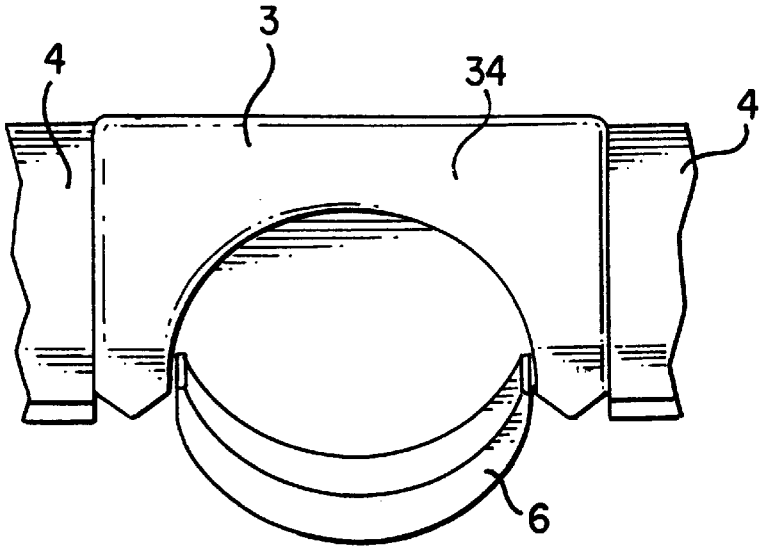
FIG. 2B is a top view of a side pocket according to the invention.
Figure 3A:
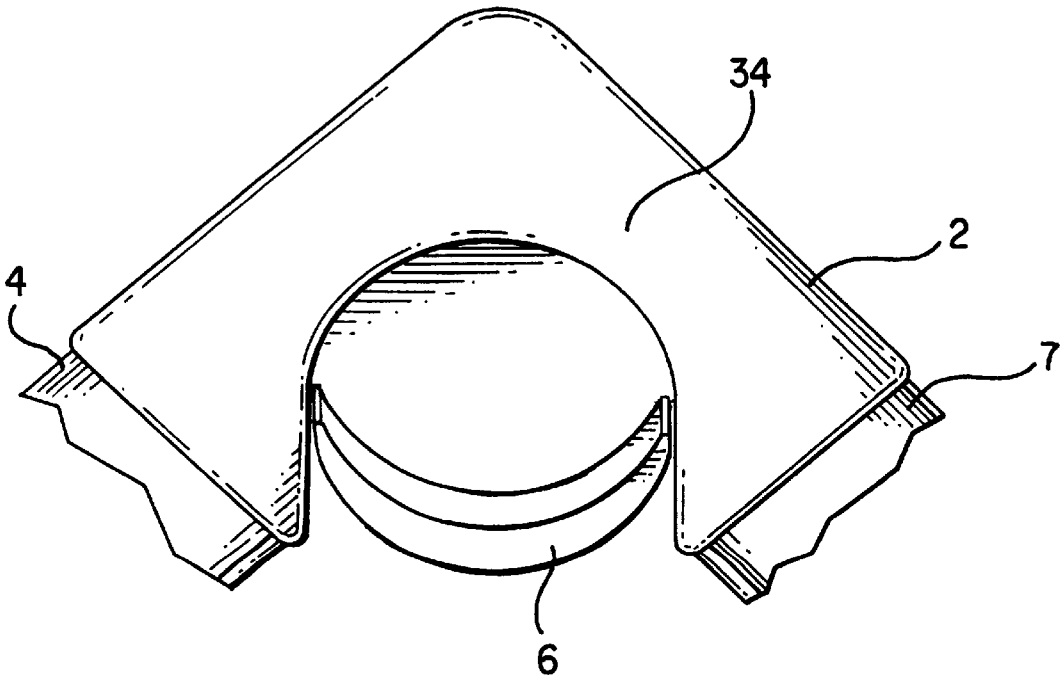
FIG. 3A is a top view of a corner pocket according to the invention.

FIGS. 2B and 3A show perspective views of a side pocket 3 and a corner pocket 2 according to the invention. Inserted in each pocket is the retaining ramp 6 having connectors 11. The ramps 6 are formed in the shape of crescents and have a slightly convex shape. The connectors 11 are inserted into the side walls of the pockets and are removably held in place as shown in FIG. 6. In order to secure the retaining ramps 6, the pockets 2, 3 are slightly lifted off the playing surface 5 , care being taken not to dislodge the fastened connection between the rails 4, 7 and the playing surface 5.

Figure 3B:
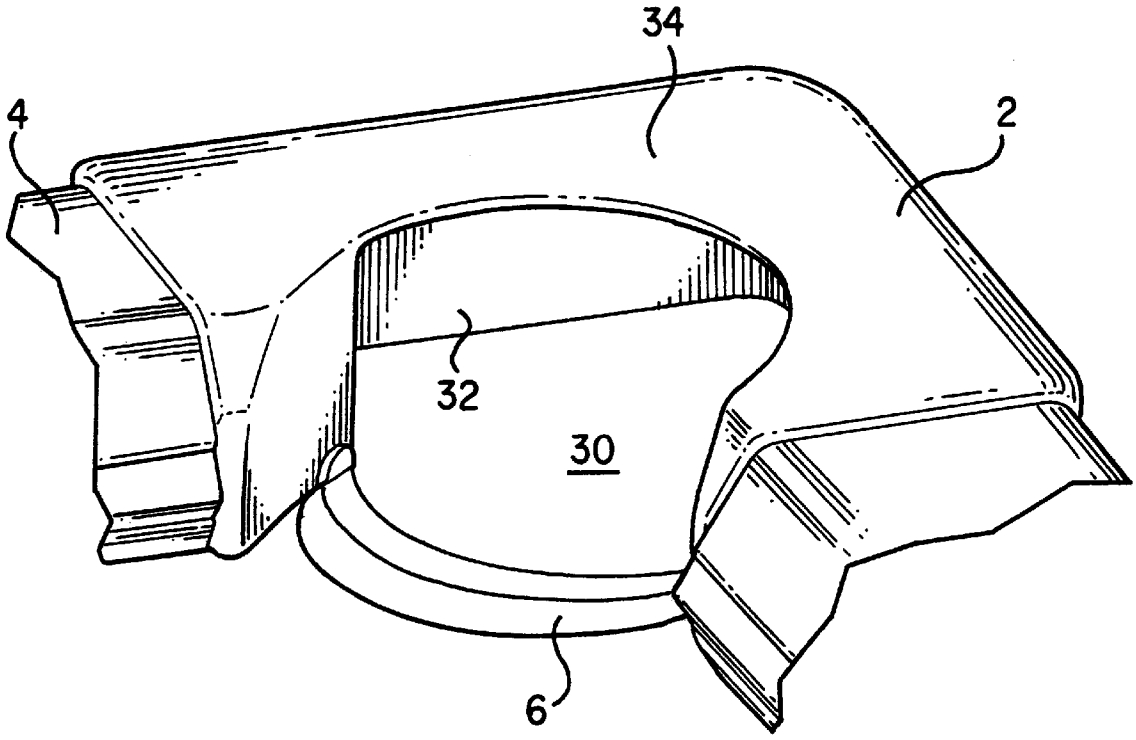
FIG. 3B is a perspective view of a corner pocket according to the invention.

As shown in the perspective views of FIGS. 2A and 3B and the top views of FIGS. 2B and 3A, each of the pockets 2, 3 includes an interior space 30 formed by the side walls 32 and the top surface 34 of the pockets. As such, the side and corner pockets 2, 3 realistically simulate an actual billiard pocket, although they may be sized to conform to a standard golf hole.

Figure 4:
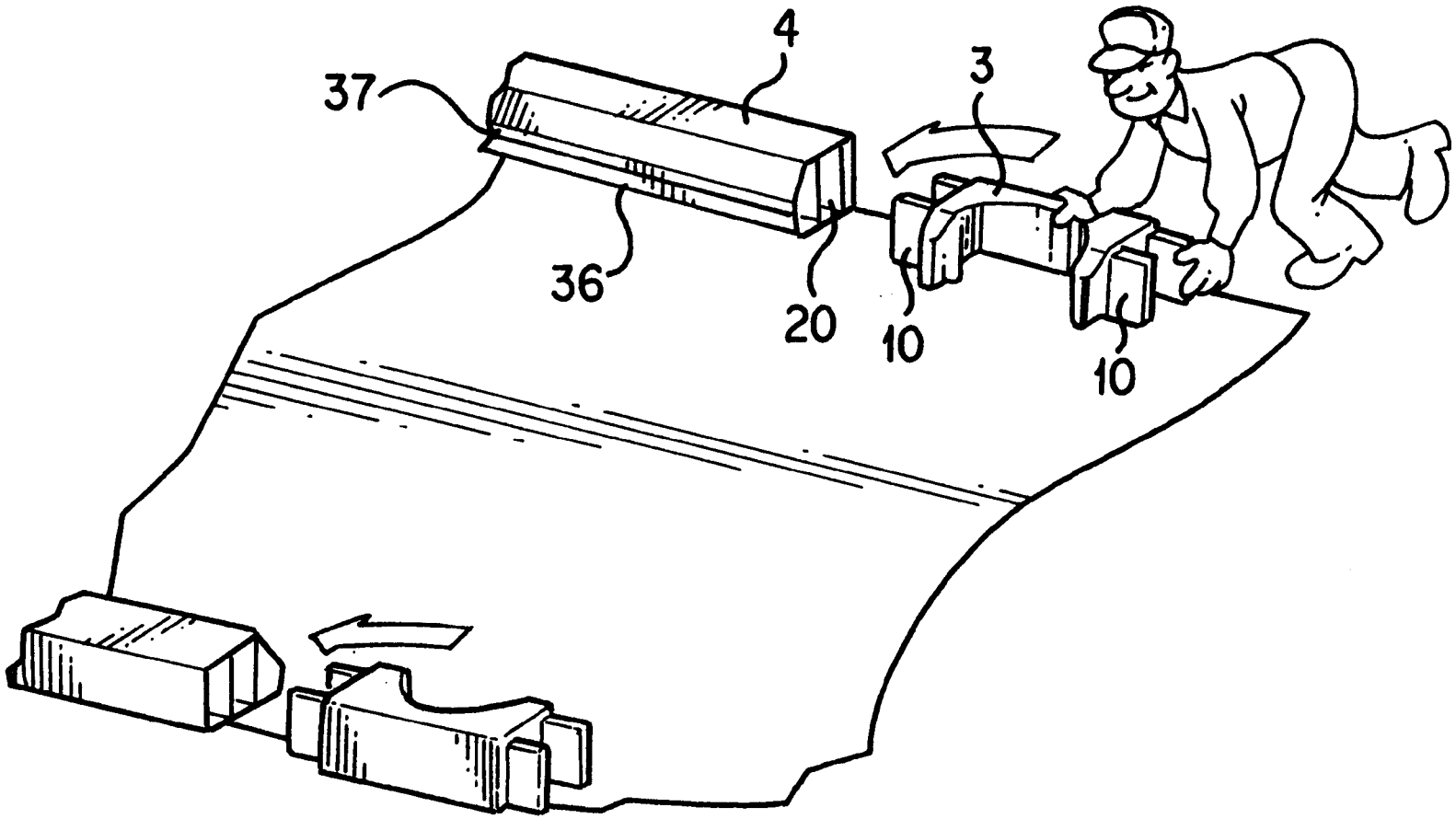
FIG. 4 is perspective view illustrating the connection between a side ball pocket and a side rail according to the invention.

Referring to FIG. 4, there is shown an enlarged representation illustrating the connection between a side pocket 3 and a rail 4. As shown, the side pocket 3 includes male connectors 10 which frictionally engage into a female receptacle 20 formed at an end of the side rail 4. Arrow 40 indicates the insertion direction for coupling the side pocket 3 to the side rail 4.

Also shown in FIG. 4 is a bumper 36 formed on the side rail 4 (a similar bumper being formed on the end rail 7). The bumper 36 can be co-extruded together with the hollow extrusions forming the rails 4, 7. This simplifies the manufacture of the rails in the present invention while providing a realistic simulation of an actual billiard table rail/bumper system. Additionally, a rubber strip 37 can be arranged on the inside of the bumper 36 to enhance a ball's reflections off of the rails.

Figure 5:
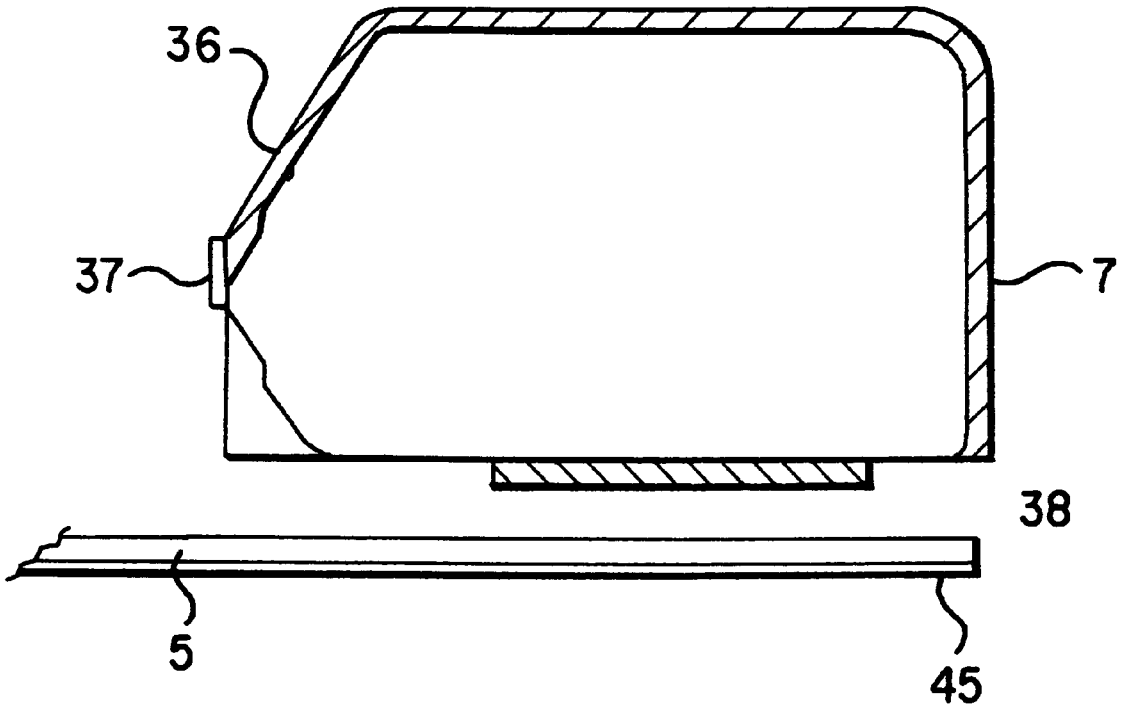
FIG. 5 is a cross-sectional view through an end rail and the playing surface, in its disassembled state, illustrating the fastener according to the present invention.

Referring to FIG. 5, there is shown a cross-sectional view through an end rail 7 illustrating the fastener 38 secured to a bottom surface thereof. The fastener 38, such as a hook and loop-type fastener, engages with a top surface of the playing surface 5. A similar fastened connection can be provided for each of the side rails 4. The use of the fastening component 38 on the respective rails of the pool table configuration advantageously prevents the playing surface 5 from being pulled away from the rails when traveled upon by the player when in use. This prevents annoying interruptions of the game in order to restretch the playing surface and reposition the location of the balls being played.

In a preferred embodiment, the hook and loop-type fastener for each rail consists of three fastening strips, one each being placed at the ends of a respective rail and a third in the center. Of course, any number of fastening strip configurations can be used so long as the rails are sufficiently secured to the playing surface in order to prevent the playing surface from pulling-away or separating from the rails which causes wrinkling.

The current invention uses a playing surface made of a material durable enough to stand on while allowing the balls to roll true. Furthermore, the material rolls up easily for storage and has a non-slip backing 45 (see FIG. 5). Preferred embodiments of the current invention utilize indoor/outdoor smooth carpet. However, regular industrial carpet or an existing floor surface could be used.

The pockets 2, 3 of the present invention store a minimum of five to six balls at the playing surface level. The balls are retained inside the pockets and are prevented from rebounding back out by the removable ramps 6 mounted between the front side walls of each pocket. The pockets connect/disconnect to the side rails for ease of assembly. Both the corner and side pockets are connected in a universal way which aids in the assembly of the invention, that is, a user does not have to determine the difference between the four corner and the two side pockets in order to assemble the game.

The openings of the pockets have the same shape as the pool pockets found on conventional pool tables. The size of the pockets in the present invention, however, differ from the pockets found on a pool table in that they are of a size corresponding to standard golf holes. The material used to construct the pockets is weather proof and is strong enough to stand on and withstand abuse.

In a preferred embodiment, the pockets are configured as an open cavity mold with male connecting prongs. Each pocket is provided with the detachable retaining ring/ramp 6 at its mouth in order to retain the balls.

The rails 4, 7 of the present invention are lightweight for portability, and are also strong enough to stand on. The rails easily connect/disconnect to the pockets. Furthermore, the rails have bumpers that closely simulate the bounce of the rails on a conventional pool table. These bumpers are co-extruded so as to be permanently secured to the rails and to be extremely durable. Rubber strips can be provided on the inside of the bumpers to enhance ball reflections. As in the case of the pockets, the material with which the rails are constructed is weather proof. The fastening device for temporarily, but securely, attaching the rails to the playing surface 5 can be provided in the form of VELCRO®, double sided tape, or the like.

Ease of assembly of the present invention is consistent with a game that is lightweight and portable. The present invention allows the disassembly of the game into a manageable size for packaging and transporting the game to different locations. The present invention can be assembled without using any tools. Thus, assembly and disassembly can be accomplished in a matter of minutes.

To easily assemble the game the following steps are followed. First the playing carpet is rolled out, allowing one to two feet of clearance area around the edge of the carpet. Any resultant wrinkles are allowed to settle before proceeding to the next step. Second, two corner pockets are connected, one to each end of a rail. Third, the assembled rail and corner pocket are aligned flush with the narrow end of the playing carpet. At this step care must be taken to ensure that the fastening device does not contact the carpet before the rails are aligned. This can be accomplished by using the plastic strip assembly aid and placing the plastic strip on top of the carpet first, sliding it out only when the rail is in the required position. The plastic strip thus prevents the fastening device from prematurely binding with the top surface of the playing carpet. Step four entails connecting side rails to corner pockets at slight angles, while keeping them straight along the edges of the playing carpet. In the fifth step, the side pockets are connected to the rails. Sixth, another pair of side rails are connected as in step four. Seventh, the final pair of corner pockets and rails are connected, as in step two. Lifting the rails aids in connecting the rails at a slight angle, using the plastic strip assembly aid as in step three. In the eighth and final step, the pockets are lifted slightly to allow the installation of the retaining ramps in openings located within the front side walls of each pocket. Consistent with the objectives of the invention, quick assembly and disassembly is accomplished by the use of lightweight materials, and modular components with universal connections.

Once assembled, the combination pool/golf table game is ready for use. Various games can be played making use of miniature pool balls, safety golf putters for making shots, as well as a golf ball for putting practice. Safety golf putters are used due to the fact that regulation steel golf putters would damage resin pool balls if used. As a result, the golf putter is provided with a protective head covering thus allowing the use of miniaturized lightweight pool balls having a size which is as close as possible to regulation golf balls. This allows the player to combine elements of both golf and pool into each shot. Of course, when the game is assembled on an elevated surface such as a table, then a conventional pool cue stick is used in lieu of the safety golf putter. This allows the player to play all conventional pool and billiard games.

The general playing rules require a determination of which player will start a particular game. To accomplish this, each player shoots a ball to an opposite end rail from which it bounces back to a head end rail. The player whose ball rests closest to the head end rail has the option to shoot first. Legal shots, in the present invention, require that the cue ball be struck only with the putter head. Any other method constitutes a foul.

If at any point during a game the cue ball is close to, touching a side rail, touching an object ball prior to the shot, or is obstructed by surrounding object balls, the shot is ruled unplayable. When this happens, the cue ball can be moved one putter head away from the side rail or the obstructing object ball (to allow a shot to be taken). If the shot is still restricted, then the cue ball can be placed anywhere to best advantage. In this case, no penalty is incurred. To make his shots, a player must make a legal stoke from a standing position. A player, however, is allowed to stand anywhere, inside or outside the playing area.

With the above general playing rules in mind, various games can be played such as "eight ball". The rules of this game require players to call shots during a game played with a cue ball and fifteen object balls, numbered one through fifteen. One player must pocket balls of the group numbered one to seven (solid colors) while the other player has balls nine to fifteen (stripes). The player pocketing his group first may then shoot at the eight ball, while first "calling" which pocket he intends to hit the eight ball into. If he misses, the game continues. If he legally pockets the eight ball, he wins.

The "eight ball" game, utilizing the present invention according to the aforementioned rules, is started by racking the object balls in a triangle at the foot of the playing area. The eight ball is placed at the apex of the rack, a striped ball in one corner of the rack and a solid ball in the other corner. The cue ball is placed anywhere no more than two feet from the head rail with the putter being used to make the "break shot". The player must either pocket an object ball or at least make contact with the balls, breaking them around the playing area. Any other shot constitutes a foul. The choice of stripes or solids is determined when a player legally pockets the first object ball.

A player is entitled to continue shooting until he fails to legally pocket a ball of his group. After a player legally pockets all group balls, he shoots to pocket the eight ball to win the game. If the ball is pocketed in any other way, the player loses the game.

According to the present invention, any balls coming to rest other than on the playing surface after a stroke are considered to be out of bounds and thus "foul". An out of bounds object ball is spotted in the center of the playing area. It is a foul (scratch, as in conventional pool) when a player drives the cue ball into a pocket. The cue ball is replaced on the playing carpet anywhere the opponent wants to best advantage. If a player is shooting to make the eight ball, he loses the game if the cue ball fouls.

Another game that may be played on the portable pool/golf game is a version of "nine ball". Here, shots are not called. Rather, the object of this game is to simply legally pocket the nine ball. Only the object balls numbered one to nine are used. The opening shooter must make contact with the number one ball first. If this is accomplished, any ball that goes in a pocket is good, and the player continues to shoot. From here, the player must always hit the lowest numbered ball. If this basic rule is kept and no fouls occur, then anything pocketed is considered legal. Whoever legally sinks the nine ball wins the game.

To start playing "nine ball", the object balls are racked in a diamond shape, with the one ball at the apex of the triangle and the nine ball in the center. The cue ball is placed no more than two feet from the head rail to make the break shot. Failure to hit the lowest numbered ball first results in play reverting to the opponent. If the cue ball is pocketed on a stroke (scratch), according to the present invention, the cue ball is replaced on the playing surface. Here, the player has the choice of placing the cue ball anywhere that gives him an advantage.

A golf style game is also possible with the present invention. The present invention may be used to play miniature golf with a number of players, where each player has a single numbered object ball. After teeing off, players take alternate shots attempting to putt their own ball into any of the six holes, by using a cue ball as in the game of pool. Each player keeps a score of the number of shots taken to sink his ball. The hole is completed when the last player "holes out". A game consists of a round of nine holes (or eighteen if preferred) with the player who has the lowest aggregate score winning the round.

To start a mini-golf game, a player must place his numbered object ball no more than two feet from the foot rail and the white cue ball should be placed no more than two feet from the head rail in order to execute a legal tee shot at the start of each hole. A putter is used to strike the cue ball down the "fairway". The cue ball must make contact with the object ball before coming to rest. If the player's object ball goes into a hole, either directly, or after hitting any number of rail cushions or other player's object balls, then this counts as a hole in one. A miss or any other shot is a foul and the player incurs a penalty stroke and must tee off again.

For fairway shots, once all of the object balls have been played onto the fairway, each player takes alternate shots to sink his own object ball into any of the six holes. The ball is allowed to go directly into the hole, hit any number of rail cushions or make contact with any other object ball in play, before dropping into a hole. Each legal shot counts one stroke towards the player's score.

If on a legal shot the cue ball is holed, then a foul occurs. When this happens, the cue ball is replaced anywhere the opponent wants to best advantage, and the player incurs one penalty stroke and loses his turn.

In order to score the mini-golf game, each hole is considered to be a par four score, with a score of three being a birdie and a score of five being a bogie, as in normal golf play. Par for the nine hole course would therefore be 36 (or 72 for 18 holes). Regular players can introduce a handicap system if desired.

If, during play, a player sinks an opponent's ball into a hole, a one penalty stroke is incurred and the player loses his turn. The opponent's ball is not returned into play, but counted as holed without adding to the score. If in the same stroke the player's own ball goes into a hole, then it must be returned into play by placing it in the center of the playing area.

If any ball is struck out of the playing area, it is considered out of bounds and a foul. The offending player thus incurs a one stroke penalty and loss of turn. A foul shot results in one penalty stroke being added to the player's score in addition to the foul stroke, that is, two strokes are added to the score. As noted above, the offending player also loses his turn.

A hole is considered completed when all players have holed out. Players who have not holed out after six shots will count that as their score for the hole and move onto the next hole.

Of course, any number of other games can be created and played on the inventive portable pool/golf game described above.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A portable pool/golf game, comprising:

a plurality of rails each having first and second rail ends;

a plurality of ball pockets, each ball pocket being arranged between adjacent ones of said plurality of said rails;

a plurality of male/female connectors coupling said plurality of rails and said plurality of ball pockets together, said connected plurality of rails and plurality of ball pockets defining a boundary;

a playing surface member having a top surface, a bottom surface and lateral edges;

wherein said boundary formed by said plurality of rails and said plurality of ball pockets is arranged at the lateral edges on the top surface of said playing surface member;

a fastener arranged on a bottom surface of said plurality of said rails to secure said boundary to the top surface of said playing surface member; and a plurality of retaining ramps each having first and second ends, said retaining ramps engaging with their respective first and second ends into openings formed in said plurality of pockets such that said retaining ramps are arranged on the top surface of said playing surface member.

2. The portable pool/golf game according to claim 1, wherein said fastener is spaced apart along a longitudinal axis of said plurality of rails on the bottom surface.

3. The portable pool/golf game according to claim 2, wherein said fastener includes three fastening strips, one strip each being placed at the ends of the rail and another placed in the middle of the rail.

4. The portable pool/golf game according to claim 1, wherein the bottom surface of said playing surface member comprises a non-slip surface.

5. The portable pool/golf game according to claim 1, wherein said retaining ramps have a crescent shape and a convex cross-section with respect to the top surface of said playing surface member.

6. The portable pool/golf game according to claim 1, further comprising a plurality of bumpers each of which is associated with a respective one of said plurality of rails along an inner surface of said boundary.

7. The portable pool/golf game according to claim 6, wherein each of said plurality of bumpers is co-extruded with one of said plurality of rails.

8. The portable pool/golf game according to claim 1, wherein said plurality of rails include four side rails and two end rails; and wherein said plurality of ball pockets includes two side pockets and four corner pockets, said boundary being constructed in a rectangular closed loop to simulate a billiard table configuration.

9. The portable pool/golf game according to claim 1, wherein said playing surface member is elevated above a ground surface.

10. The portable pool/golf game according to claim 9, wherein said elevated playing surface member is arranged on a table, and further comprising pool cue sticks used to play the portable pool/golf game.

* * * * *